US005403637A

United States Patent [19]

Pickard et al.

[11] Patent Number: 5,403,637

[45] Date of Patent: Apr. 4, 1995

[54] RESILIENT SURFACING SYSTEM

[75] Inventors: Thomas B. Pickard, Toronto; Janusz W. Mirowski, Scarborough; Anna Pietrasz, Brampton; Michael D. Burgoyne, Georgetown; James R. Jury, Brampton, all of Canada

[73] Assignee: National Rubber Technology Inc., Toronto, Canada

[21] Appl. No.: 127,363

[22] Filed: Sep. 28, 1993

[51] Int. Cl.[6] ..... B32B 3/06

[52] U.S. Cl. ..... 428/44; 428/45; 428/60; 428/61; 428/99; 428/100; 404/32; 404/35; 404/40; 472/92; 52/177

[58] Field of Search ..... 428/44, 45, 60, 61, 428/99, 100; 472/92; 404/35, 40, 32; 52/177

[56] References Cited

U.S. PATENT DOCUMENTS

| | | | |
|---|---|---|---|
| 3,304,106 | 2/1967 | McCormack | 287/20.92 |
| 3,801,421 | 5/1974 | Allen et al. | 161/67 |
| 4,073,753 | 2/1978 | Hague | 260/2.3 |
| 4,557,475 | 12/1985 | Donovan | 272/3 |
| 4,734,003 | 3/1988 | Smith et al. | 411/468 |
| 4,848,058 | 7/1989 | Mullen | 52/585 |
| 4,860,510 | 8/1989 | Kotler | 52/177 |
| 4,921,741 | 5/1990 | Mullen | 428/48 |
| 4,991,834 | 2/1991 | Vaux | 272/3 |
| 5,026,207 | 6/1991 | Heath | 405/46 |
| 5,215,802 | 6/1993 | Sijpesteijn | 404/40 |

FOREIGN PATENT DOCUMENTS 2733311 2/1979 Germany .

*Primary Examiner*—Alexander S. Thomas
*Attorney, Agent, or Firm*—Ridout & Maybee

[57] ABSTRACT

A theft and vandalism resistant resilient surfacing system having resilient mats molded with recesses in their upper sides extending part way through the mats adjacent the edges and corners. Connector plates extend beneath the juxtaposed edges of adjacent mats and have posts extending upwardly through narrow openings in the bottom portions of the recesses. Means are provided for abutting on the upper sides of the bottom portions and retaining the upper ends of the posts. Preferably, the posts have stiffly resiliently deformable arrowhead formations on their upper ends which snap couple with the openings in the bottom portions.

10 Claims, 4 Drawing Sheets

RESILIENT SURFACING SYSTEM

The present invention relates to resilient surfacing, primarily intended for use outdoors.

It is known to employ resilient mats to provide a resilient safety surfacing installed permanently on the ground surface adjacent children's outdoor climbing and play equipment. The mats are arranged to form a continuous resilient surface which acts as a cushioning material and guards against injury in the event of a child falling from the equipment.

Unfortunately, such resilient matting systems are vulnerable to vandalism by persons who remove mats from the surfacing. Proposals have been made for connectors for interconnecting adjacent mats in a resilient surfacing to prevent removal of individual mats, but the connector systems of which the applicant is aware have not been as efficient or effective as is desirable.

BRIEF SUMMARY OF THE INVENTION

In the present invention, in order to provide a vandal-resistant resilient surfacing, there are used resilient mats which have recesses formed in the upper sides of the mats adjacent their edges. The recesses each extend part way through the thickness of the mat and terminate in a web portion providing an upwardly-facing bottom surface which is spaced upwardly from the lower side of the mat. An opening is provided passing through the web portion to the lower side of the mat. In combination with the above mats, there are employed connector members each comprising a plate having at least two spaced apart posts upstanding from it. The posts are of a width that they are insertable through the respective openings of two mats when juxtaposed with their recesses positioned in lateral registry. Means are provided for abutting on the upwardly facing bottom surface of the recesses for retaining the post non-retractably when inserted through the openings in the lower sides of the mats. Preferably, the posts have enlarged upper ends which snap through the openings in the web portions.

The connector plates described above are simple to install and are highly effective in resisting removal of mats from the surfacing system. Moreover, they can be employed with mats of varying sizes and shapes, and are well adapted to be used with ground anchors which may be passed through apertures provided in the plates, in order to provide a multiplicity of points intermediate the edges of the surfacing system where the mats are firmly anchored to the ground.

BRIEF DESCRIPTION OF THE DRAWINGS

Some preferred embodiments of the present invention will now be described in more detail with reference to the accompanying drawings, in which.

Figure 7:
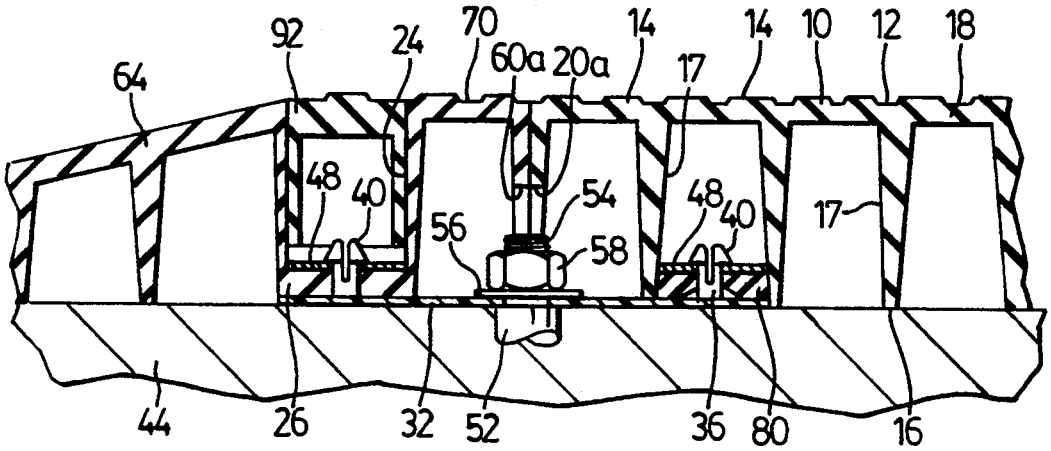
FIG. 7, which appears on the same sheet as FIG. 2, is a cross-section taken on the line 7—7 in FIG. 6.
Figure 6:
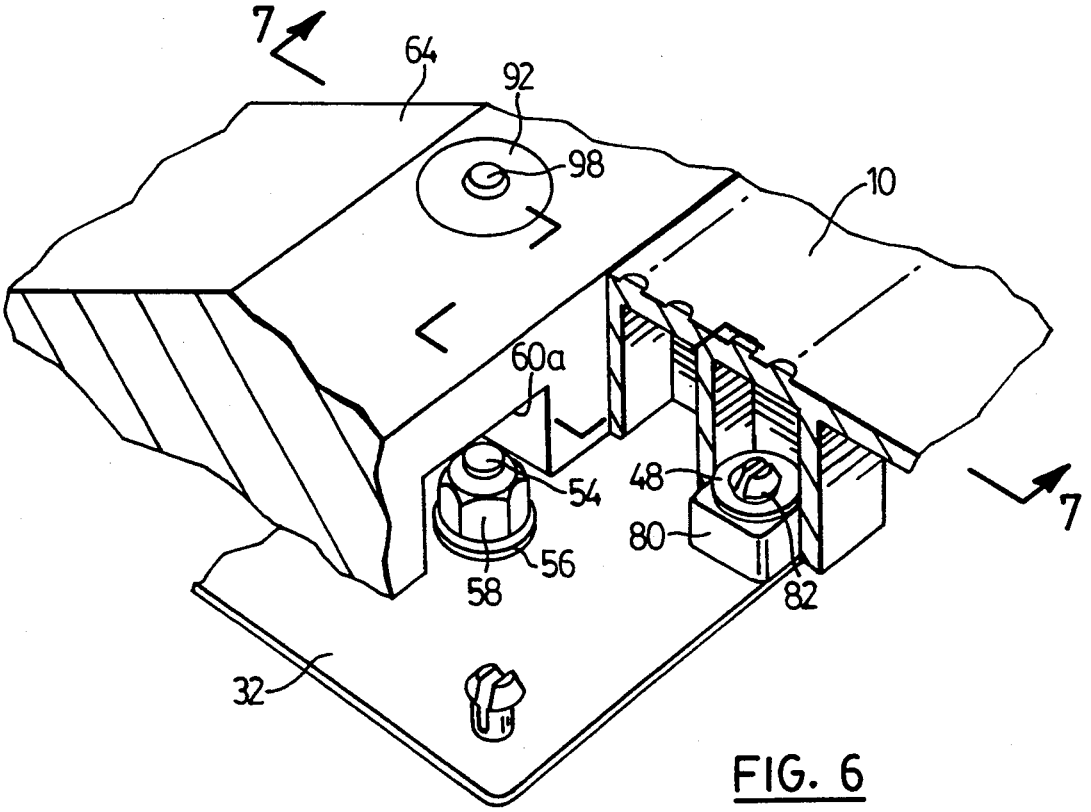
FIG. 6 is a partial perspective view of an edge portion of the matting, illustrating an auxiliary connection arrangement using mobile plugs secured to the lower side of the mats.

FIG. *7a* is a cross-section on an enlarged scale through the mobile plug as used in FIGS. 6 and 7.

DETAILED DESCRIPTION

Referring to the drawings, a resilient surfacing system is formed from rectangular mats 10. Mats of other shapes are contemplated for use in the present invention. In the preferred form, the mats 10 are each molded monolithically from rubber. Preferably, the mats are molded from a recycled tire crumb material comprising automobile tire crumb that is bonded together with a curable binder to form a moldable mass, the moldable mass then being molded to the desired shape and size and being cured using conventional curing techniques. A desirable characteristic of such mats formed in this way is that they have great resiliency and combined with high structural strength, so that, when anchored with a point anchoring system in accordance with the invention, they will resist tearing at the anchoring points at least when subjected to forces normally capable of being exerted by human hand pressure. It is, however, contemplated that other forms of resilient mat which provide sufficient resiliency and strength may be employed in combination with the connector system described herein.

The mats 10 have a continuous planar upper side 12 formed with a closely-spaced array of anti-slip circular stud like projections 14, which cover the upper surface 12 in a closely-spaced array. For the sake of clarity of illustration, these studs 14 are not shown in FIG. 1.

Figure 1:
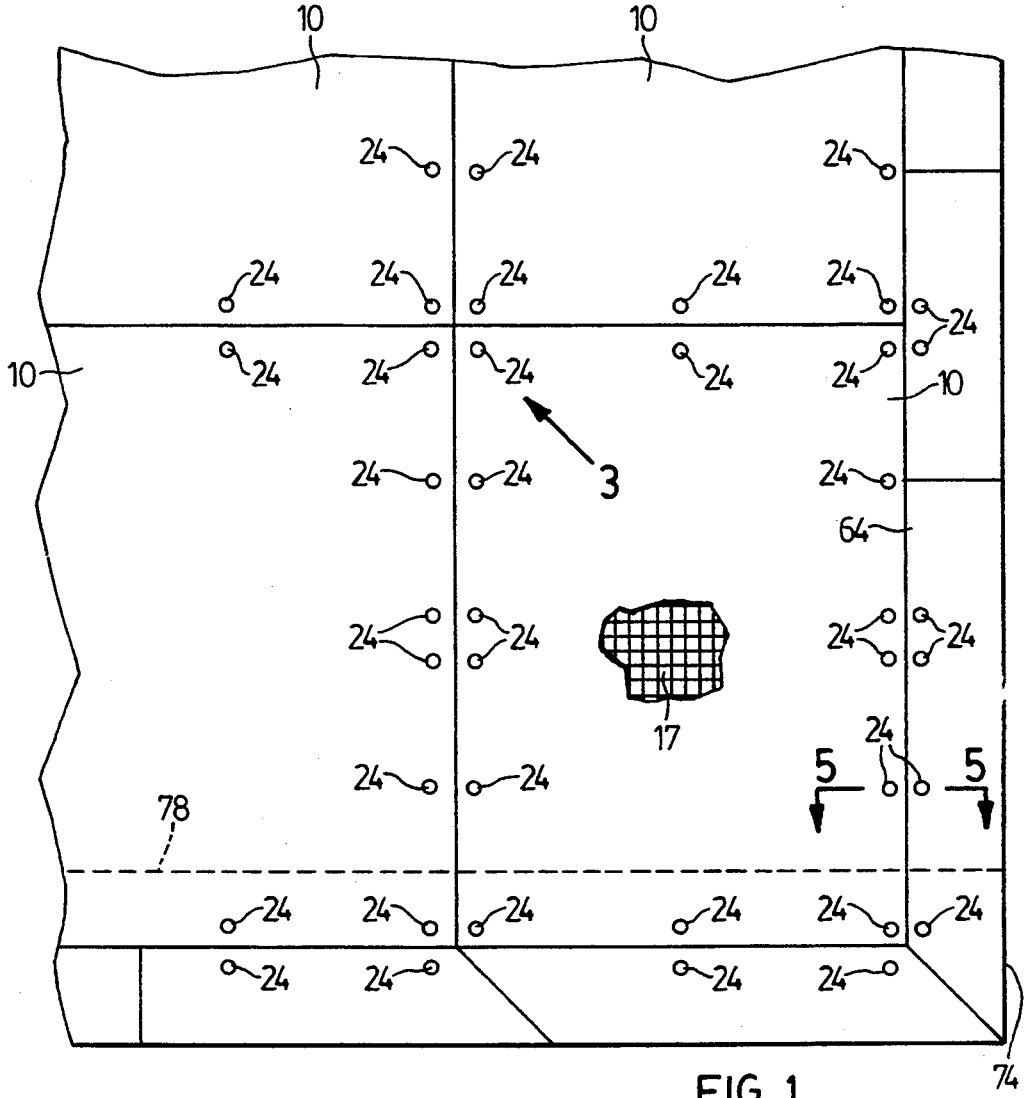
FIG. 1 is a partial plan view of a resilient surfacing formed from a combination of mats and connector elements in accordance with the invention.
Figure 2:
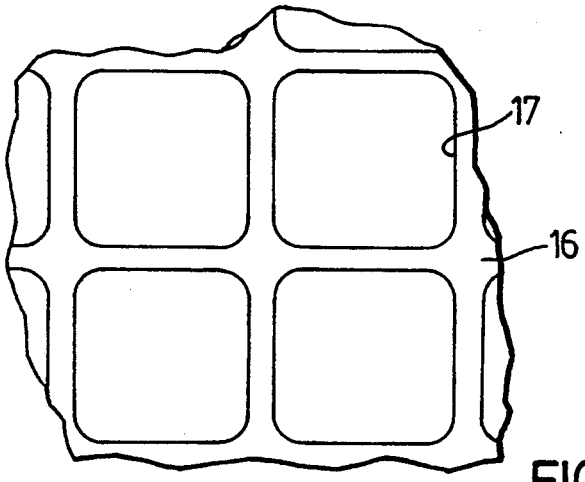
FIG. 2 is a view on an enlarged scale of the cellular underside of a mat of the surfacing shown in FIG. 1.

In the preferred form, as seen in a small area cut away in FIG. 1, and as shown in FIG. 2, the lower side 16 of the mat is planar, and is interrupted by a series of uniform cells 17 that extend most of the way through the thickness of the mat 10, so that, in effect, the mat comprises an upper web 18 supported on a network of vertical members formed by sidewalls 20 of the cells 17. In the preferred form, the cells 17 are substantially square with rounded corners in lateral cross section and taper as seen in vertical cross section towards the upper web 18. The cells are formed in a closed packed array. Other cellular arrangements are, of course, possible.

Figure 3:
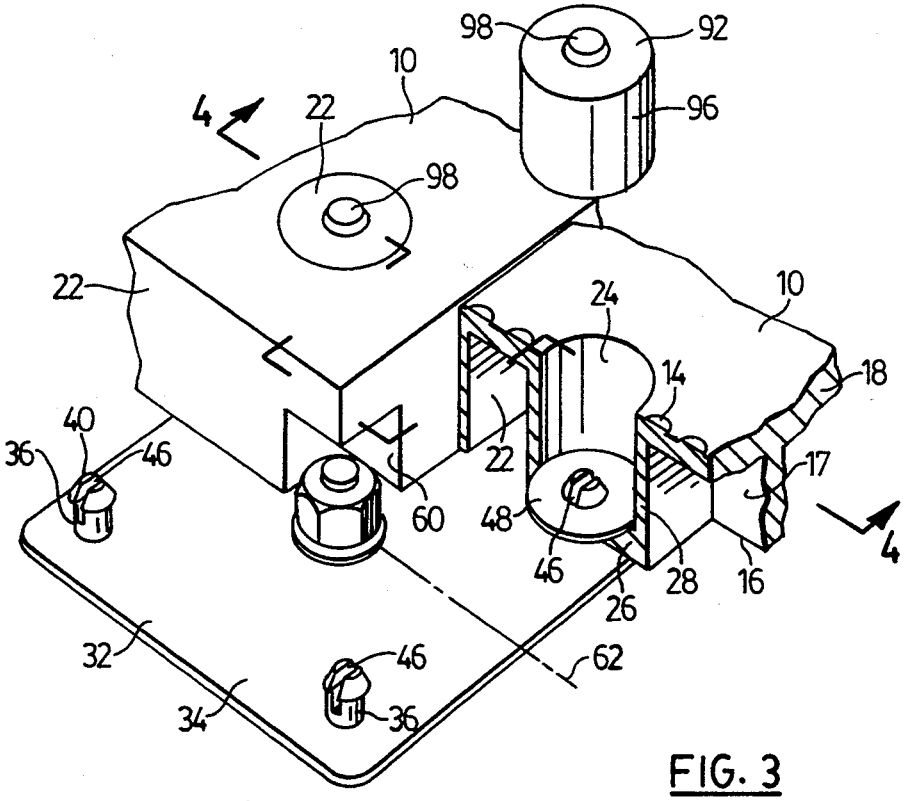
FIG. 3 is a partial perspective view on an enlarged scale of an area of the surfacing system indicated by the arrow 3 in FIG. 1.

As seen in, for example, FIG. 3, each mat 10 is formed with continuous vertically extending planar molded side walls 22, and with a series of recesses 24 in its upper side. These recesses are provided adjacent each corner of each mat, and at intervals along the length of each side and are molded in the mat 10 so that they extend downwardly part way toward the lower side 16 of the mat to a lower web portion 26 which is integrally connected with the upper web 18 through side walls 28. The upper side of the lower web portion 26 provides an upwardly facing bottom surface 30 for the recesses 24.

Figure 5:
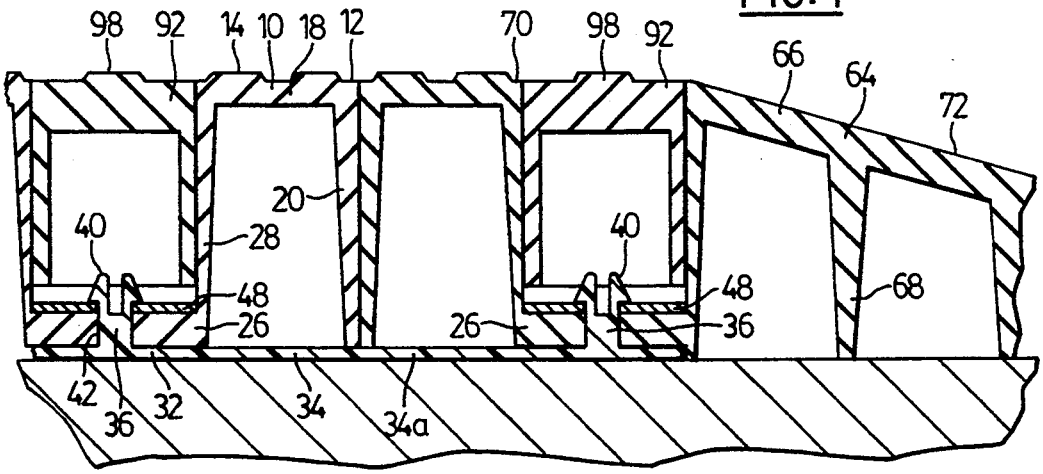
FIG. 5, which appears on the same sheet as FIG. 1, is a cross-sectional view taken on the line 5—5 in FIG. 1.
Figure 4:
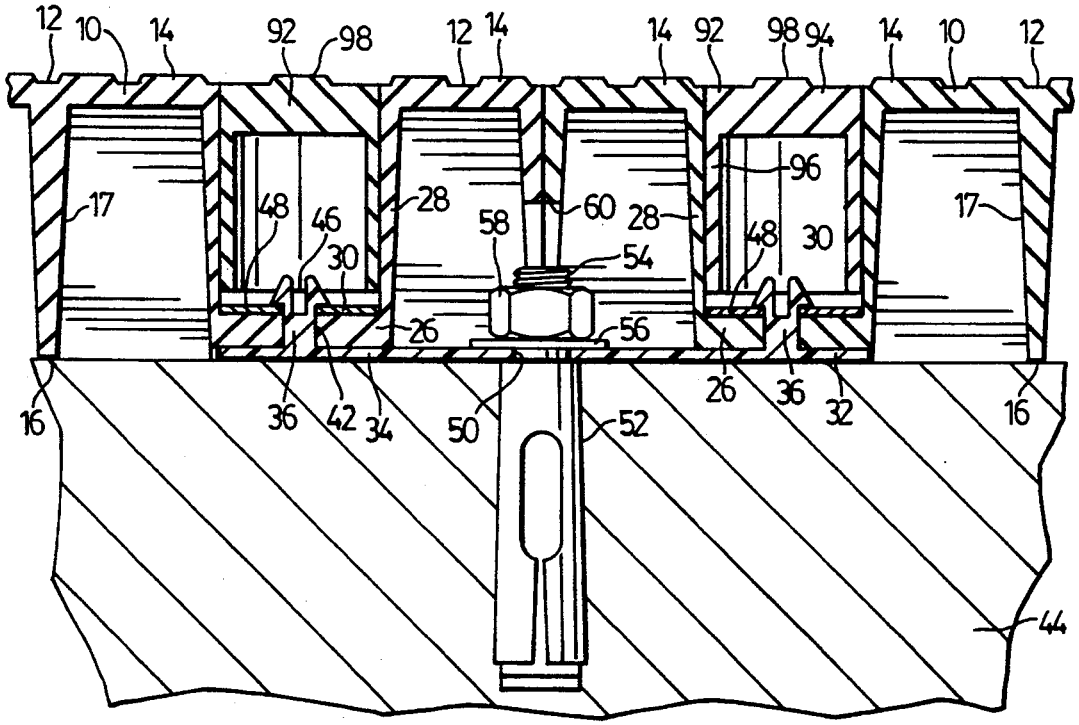
FIG. 4 is a cross-sectional view on the stepped cross-sectional line 4—4 in FIG. 3.

As best seen in FIGS. 3 to 5, the mats are used in conjunction with connector members 32. In the preferred form, the members 32 comprise a rectangular, preferably square plate 34 provided with four posts 36 upstanding from each of its corners. As seen in FIG. 4, desirably the lower side of the lower web portion 26 is offset upwardly from the plane of the lower side 16 of the mat to accommodate the thickness of the plate 34.

Each post 36 is formed with an enlarged end 40 adapted to snap through openings 42 molded in the web portions 26. Preferably, the enlarged end is a substantially frustoconical arrowhead like member. The barb or lower portion of the arrowhead 40 extends laterally outwardly with respect to the shaft of the post 36. The openings 42 are of the same width or slightly smaller than the width of the shaft portion of the post 36.

In assembling the resilient surfacing system, where a group of four recesses 24 is present, as at a corner between four juxtaposed mats 10 as seen in FIGS. 1, 3 and 4 or at points approximately half way along the sides of the mats, where two adjacent pairs of the recesses 24 are brought into registry, a connector plate 32 as seen in FIG. 3 is first positioned on the surface of the ground or other underlying substrate 44. As will be appreciated, the recesses 24 and posts 40 are disposed so that, when the side walls 22 of adjacent mats are butted closely together, the upper ends of the posts 36 are in registry with the openings 42 through the lower web portions 26. Downward pressure is then applied on the upwardly facing bottom surfaces 30 of the recesses 24, in order to force the lower web portions 26 downwardly and snap them over the enlarged arrowhead portions of the posts 36. If necessary, a short length of pipe or a similar tubular tool may be applied on the upper side of web portion 26 and driven downwardly to assist snapping the arrowhead portions 40 through the openings 42. Desirably, the upper end of each post 36 is formed with a transverse slot 46, which divides the arrowhead portion 40 substantially symmetrically. The slot 46 assists in passage of the portion 40 through the opening 42, by allowing inward deformation or deflection of the portion 40. Preferably, a rigid, for example metal, washer 48, having a central opening narrower than the widest portion of the arrowhead 40 is snapped over the arrowhead portion 40, for example by applying the opening in the washer on the upper side of the arrowhead and striking it with the pipe or other tubular tool referred to above. Preferably, the distance between the lower side of the arrowhead 40 and the upper side of the plate 34 is such that the washer is retained snugly or tightly compressively between the arrowhead and the upper side of the web portion 26. The washer 48 serves to distribute stress which may be applied to the mats 10 in ordinary service and especially when an attempt is made illicitly to remove the mats, so as to reduce risk of the arrowheads 40 and posts 36 causing tears in the resilient material of the mats 10.

As seen in FIGS. 3 and 4, preferably the recesses 24 and washers 48 are circular, but other cross-sections may, of course, be employed.

In the preferred form the connector member 32 is molded from a stiffly resilient plastics material so that it will snap-couple firmly with the openings 42 of the web portions 26. It may be molded for example of nylon, or polypropylene. Preferably it is molded from 10% glass filled acetal resin.

Other forms of connector plate may, of course, be employed. For example, the connector plate 32 may be a metal plate with threaded posts similar to the posts 36 upstanding therefrom. In such case, an abutting engagement may be formed between the upper ends of the posts and the upper side 30 of the lower web portion 26 by pressing a spring locking washer of the kind known as a SPEED NUT downwardly over the threaded posts, so that the spring washer engages tightly downwardly, either on the upper side of a stress-distributing washer 48, as shown, or directly on the upper side 30 of the lower web portion 26.

In the preferred form, the connector member 32 is provided with a central opening 50 through the plate 34. When installing the connector member 32, a mechanical fastener may be passed through the opening 50 in order to secure the plate 34 to the ground surface. For example, as shown in FIG. 4, a sleeve anchor 52 may be inserted into a concrete or other rigid substrate 44. The anchor 52 has an upstanding threaded stud 54 over which is applied successively the plate 34, a washer 56, and a nut 58 which is then tightened down to anchor the connector member 32 firmly to the substrate 44.

As seen in FIG. 3, each corner of each mat 10 is preferably molded with a corner recess 60 in its underside, in order to accommodate the stud 54, washer 56 and nut 58. Recesses similar to the recess 60 may be provided on the lower portion of each side edge of each mat 10 where, in the assembled mat structure, a group of two pairs of similarly spaced recesses 24 are present, for example as shown approximately half way along the longer sides of the mats 10 in FIG. 1, so that similar ground anchorage to that shown above in connection with FIGS. 3 and 4 may be applied.

At points in the surfacing, a pair of recesses 24 may be presented in lateral registry, for example where a single recess 24 along a side of one mat 10 is presented in registry with a recess 24 on an adjacent edge of a similar mat. In such a case, a connector plate with upstanding posts similar to that described above in connection with FIGS. 3 and 4 may be employed, but having only two longitudinally spaced posts 36. Such connector plates may conveniently be provided by cutting in half the connector plate 32 shown in FIG. 3 along a chain dotted line indicated at 62 in FIG. 3, to provide a half plate.

FIG. 5 illustrates the application of such half plate **34*a* at an edge of the surfacing where an inclining ramp or edging portion 64 is employed, to provide a smoothly sloping transition between the ground surface and the upper side of the mats 10. The edging portion 64 is preferably molded of the same resilient compositions as the mats 10 and preferably has similar structure in that it has a continuous upper web 66 and a cellular lower side defined by intersecting generally rectangular walls 68. The material 64 is relatively narrow and elongated, and has an inner margin portion 70, which may be, for example, about two rectangular cells in width and which is of the same thickness as the mats 10, and a downwardly outwardly sloping portion 72 extending from the portion 70 to a thin outer edge portion 74** which, as seen in cross-section, may be formed with a rounded nose portion.

As seen in FIG. 1, the edging material 64 may be provided in the form of pieces of varying length having recesses 24 similar to those of the mats 10 molded along the inner margin and adapted to be placed in registry with corresponding recesses 24 in the mats 10. The material 64 may include portions integrally molded to have mitred ends, in order to provide a mitred corner for the surfacing, as seen in FIG. 1, or, less desirably, the material 64 may be cut to provide it with mitred corners.

As seen in FIG. 5, the half plate 34 connects between the edge portion 64 and the mat 10, with the upstanding posts 36 inserted through the openings 42 in the bottom of recesses 24 provided in the mat 10 and in the inner margin 70 of the edge material 64, respectively. As described above in connection with FIGS. 3 and 4, the arrowhead portions 40 are snap-locked through openings in the washers 48 engaging the upwardly facing bottom surfaces of the lower web portions 30.

A connector member 32 with one corner cut off may similarly be used to form a three-point connection to regions at which a group of three recesses 24 are present, for example at the mitred corner or half way along the lower edge of the surfacing as viewed in FIG. 1.

Figure 7A:
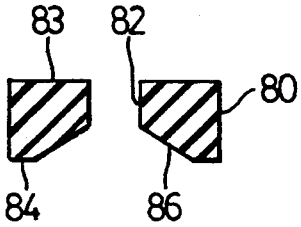

A variety of sizes of the mats 10 may be provided, so that it is possible to construct resiliently surfaced areas of a wide range of differing areas and shapes. On occasion, however, it may be necessary to cut or trim off an edge portion of the mats, in order to provide a resilient surfacing of a given size or shape, for example by cutting the mats along the broken line 78 indicated in FIG. 1, with the result that the molded-in connecting recesses 24 are lost along that edge of the mats 10. In such a case, a mobile plug 80 may be used, as seen in FIGS. 6, 7 and 7*a*, to provide for connection between a connector plate 32 and the lower side of the cut-off edge of the mat 10. The plug 80 is formed from resilient material, and is preferably molded from the same composition as employed for the mats 10 and edging material 64. The sides of the plug 80 are square with rounded corners, and conform closely to the rectangular recesses 17 in the underside of the mat 10. A through opening 82 passes between the planar sides 83 and 84 of the plug 80, and a conical recess 86 is provided on one side 84 of the plug 80 to facilitate pressing the plug 80 downwardly over the post 36, so that the arrowhead formation 40 on the post 36 can snap through the opening and engage on the upper side 83 of the plug 80.

In use, after anchoring the connector member 32 to the substrate 44 if desired using a sleeve anchor 52, as described above, a connection is formed with the edging member 64 as described above by snapping the arrowhead formation 40 through the lower web portion 26 of the molded-in recess 24 on the marginal portion 70 of the edge material 64, and snapping a washer 48 over the arrowhead 40. While the cut edge of the mat 10 is still free, a mobile plug 80 is snapped onto each of the posts 36 which will underlie the edge of the mat 10. Preferably, a washer 48 is then snapped over the arrowhead 40 to provide a secure tear-resistant connection between the plugs 80 and the connector plate 32. Adhesive is then applied on the outer sides of the plugs 80 and on the side surfaces of the rectangular recesses 17 which will receive them. The edge of the mat 10 is then pressed down firmly over the plugs 80 to bond the plugs 80 within the recesses 17 and provide a secure attachment between the edge of the mat and the connector member 32.

As seen in FIGS. 6 and 7, a sidewall 22*a* of the edging material 64 may be molded with a recess at 60*a* and the sidewall portion 20 of the recess 17 may be cut away at 20*a* to accommodate the stud 54, washer 56 and nut 58 which may be secured to the sleeve anchor 52.

Desirably, to close up the molded-in recesses 24, closure plugs 92 are inserted in the recesses 24, and are preferably bonded in place with an adhesive. As seen in FIG. 3, the plugs 92 are of a cross-section similar to the recesses 24, for example circular. As seen in FIG. 4, the plugs 92 have a relatively thick upper web portion 94 and a depending skirt 96 which extends within the recess 24. Preferably, the plugs 92 are molded from the same composition as the mats 10 and edge material 64. The web portions 94 of the plugs 92 may be molded with upstanding stud portions 98 to blend with the studding provided on the upper sides of the mats 10 and to provide an anti-slip surface.

I claim:

1. In combination, a plurality of resilient mats each having an upper and a lower side and having adjacent the edges thereof recesses each formed in the upper side and extending part way through the thickness of the mat and terminating in a transversely extending web portion an upper side of which defines an upwardly-facing bottom surface of the recess spaced upwardly from said lower side, an opening passing through said web portion to the lower side of the mat, and at least one connector member comprising a plate applied at the underside of juxtaposed mat edges and having at least two spaced posts upstanding therefrom, and inserted through the respective openings of two juxtaposed mats having their recesses positioned in lateral registry, and abutment means abutting on said upwardly facing bottom surface and for retaining each said post when inserted through said opening non-retractably therein.

2. The combination of claim 1 wherein said plate and posts are formed from stiffly resilient plastics material and said abutment and retaining means comprise an enlarged upper end of each post adapted to snap through said opening in said web portion.

3. The combination of claim 2 wherein said upper end is of arrowhead cross section.

4. The combination of claim 3 wherein said upper end is substantially conical.

5. The combination of claim 3 wherein the upper end of the post is divided by a transverse slot.

6. The combination of claim 2 including a substantially rigid washer having a central opening through which said enlarged upper end snaps-through and retained between said upper end and said upwardly facing bottom surface, said washer having an outside width substantially equal to the width of said recess.

7. The combination of claim 1 including mechanical fastener means passed through an aperture in the plate for securement in the ground under the mats.

8. The combination of claim 1 wherein said mats are substantially rectangular and including elongated rectangular edging strips tapering in thickness from one longitudinal edge to an opposite edge.

9. The combination of claim 1 wherein the lower side of the mats is formed with an array of uniform cells recessed therein, and including a resilient anchoring plug fitting snugly within said uniform cells and having an opening through it for receiving a post of a connector member.

10. The combination of claim 1 including resilient closure plugs adapted to close said recesses formed in the upper sides of the mats.

* * * * *